United States Patent [19]

Hall et al.

[11] 4,365,828

[45] Dec. 28, 1982

[54] SKATE GUARD

[76] Inventors: Bradley G. Hall; Gwendolyn L. Hall, both of 60 Redcar Ave., Islington, Ontario, Canada, M9B 1K1; Valbory Grant, 1321 Redbank Cres., Oakville, Ontario, Canada

[21] Appl. No.: 121,455

[22] Filed: Feb. 14, 1980

[30] Foreign Application Priority Data

Feb. 21, 1979 [CA] Canada ..... 322040

[51] Int. Cl.[3] ..... A63C 3/12

[52] U.S. Cl. ..... 280/825

[58] Field of Search ..... 280/825; 30/151, 286, 30/382

[56] References Cited

U.S. PATENT DOCUMENTS

| | | | |
|---|---|---|---|
| 2,181,834 | 11/1939 | Pierce et al. | 280/825 |
| 3,637,231 | 1/1972 | Weidenbacker | 280/825 |

FOREIGN PATENT DOCUMENTS

| | | | |
|---|---|---|---|
| 671133 | 9/1963 | Canada | 30/382 |
| 579716 | 12/1931 | Fed. Rep. of Germany | 280/825 |
| 13751 | of 1895 | United Kingdom | 280/825 |
| 379611 | 9/1932 | United Kingdom | 280/825 |
| 536193 | 5/1941 | United Kingdom | 280/825 |

*Primary Examiner*—Robert R. Song
*Assistant Examiner*—Michael Mar

[57] ABSTRACT

A skate guard designed to extend longitudinally along the bottom edge of the skate blade is shaped to define an upwardly opening groove to receive a skate blade. Over part of its length the groove narrows toward its upper opening to a transverse dimension less than the thickness of the skate blade. The guard is made of flexible resilient material whereby when a skate blade is inserted in said groove the material of the guard is resiliently biased outwardly by said blade and acts to grip it. Preferably the guard is shaped so that, when so biased by the blade, the lower surface of the guard is concave downward in transverse cross-section.

23 Claims, 8 Drawing Figures

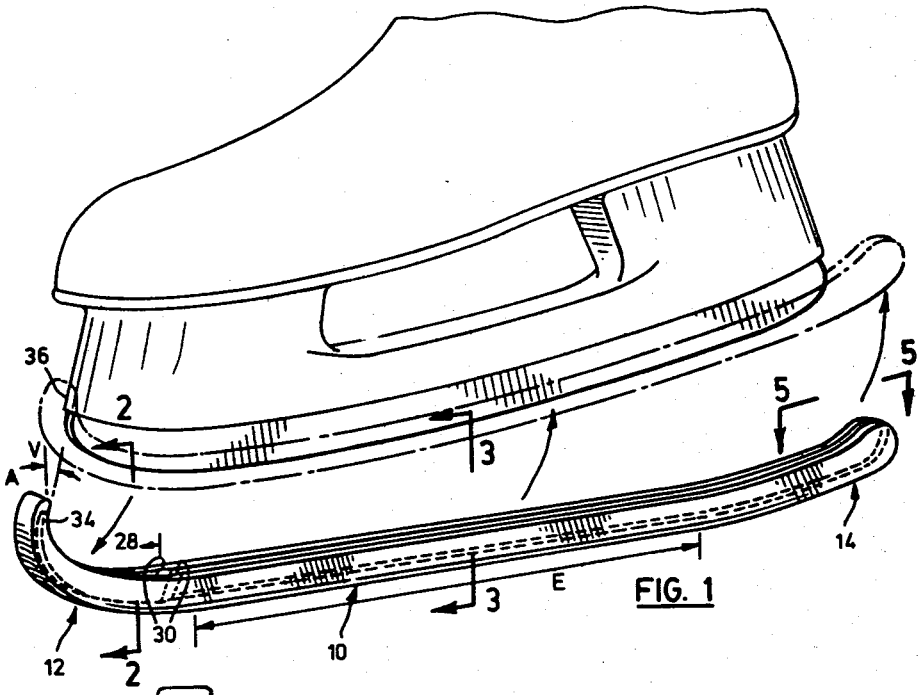
FIG. 1
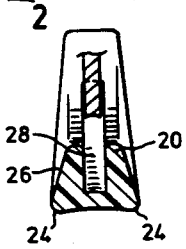
FIG. 2
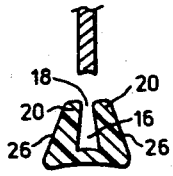
FIG. 3
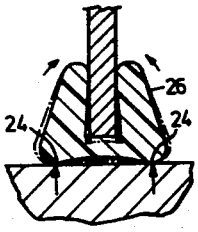
FIG. 4
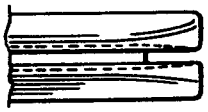
FIG. 5
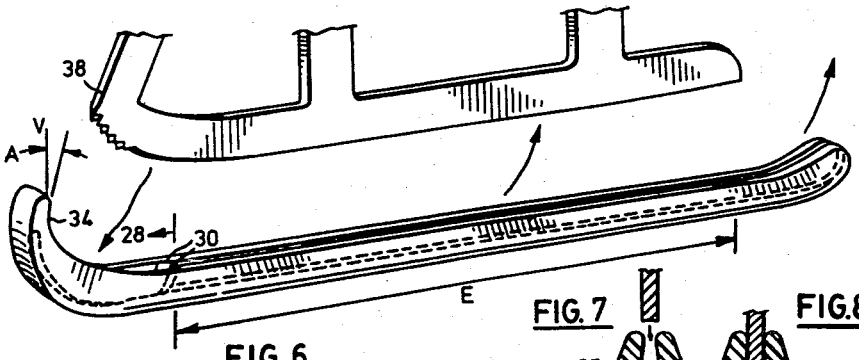
FIG. 6
FIG. 7
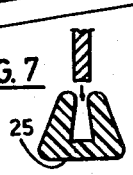
FIG. 8
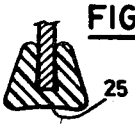

SKATE GUARD

This invention relates to a skate guard.

Skates formerly had posts attaching the blade to the skate boot and the blade projected rearwardly of the posts. A certain type of skate guard was provided which covered the blades of the skate when the wearer was not on ice by hooking over the forward end of the blade and having a spring attachment to the rear projection. When off the ice the wearer walks with his skates and skate guard on, on a surface usually other than the ice.

Skates have recently been redesigned and instead of the steel posts a molded plastic member connects the boot to the blade, and partly encases the upper portion of the blade. With the new construction, the plastic extends from near the front to near the back of the blade and the absence of a rearward projection of the blade inter alia renders it impossible to attach the present design of guard thereto.

This invention having the features as described hereafter, allows the provision of a useful skate guard which may be made in one piece and does not require any fittings or attachments.

This invention provides a novel type of skate guard for attachment to the newer form of skate. The novel skate guard is shaped from flexible, resilient material and defines an upwardly facing groove to receive the blade. The groove is shaped to be narrower at its opening than at the bottom and the opening is of smaller width than the thickness of the blade. Thus when the blade is thrust into the groove the material defining the groove is sprung apart to receive the blade and resiliently clamps the blade in the guard.

(It should be clear that, although the new skate design supplied the impetus for design of the inventive guard described herein, the inventive guard is quite suitable for use with skates of older design whether the hockey, figure or speed skating).

Preferably, the guard defined in the previous paragraph, is provided with a specially shaped longitudinal extent on its lower surface for contacting the floor or other support surface when the wearer of the skates and guard is walking on them. The longitudinal extent is preferably shaped, in transverse cross-section, in the unstressed attitude of the guard to be concave downward on its lower surface. This means that the weight of the wearer is, on each guard, borne by two spaced longitudinal downwardly projecting ridges running longitudinally on each side of the concavity. The weight of the wearer causes resultant bending pressure on the guard causing the guard material to move downwardly between the ridges while the material defining the groove on each side of the blade is bent inwardly increasing the pressure of the guard material which defines the groove, inwardly on the blade and thus increases the security of the grip of such guard material on the blade.

In an alternative preferred form of the invention described in the previous paragraph the guard having a groove with a narrower opening is shaped when not in use, so that, in transverse cross-section, the lower surface runs substantially straight transversely on the guard. However, when the blade is inserted in the guard, the outward pressure of the blade on the guard material defining the narrowed groove, causes such guard material to be flexed outwardly resulting in the production of a lower guard surface which is concave downward in transverse cross-section and provides longitudinally running ridges on each side of the guard. As described in the previous paragraph, when such guard on a skate is placed on the floor, the weight of the wearer produces a bending pressure on the guard material, increasing the inward pressure on the guard material on the blade increasing the security of the grip of such guard material on the blade.

Preferably the bottom of the longitudinal extent of the guard as described in the previous paragraph is made wider, in a transverse direction, than the upper portion of said guard, and the outer sides of the guard taper upwardly and inwardly from the bottom to the upper portion. This shaping of the guard not only strengthens it but is effective to transmit the bending stresses from the ridges on the base to the guard material (in either alternative form of the invention) on each side of the groove to press it inwardly on the blade.

The upper part of the groove which is over a large portion of its extent, narrower than the blade, is provided with a widened portion at the forward end of the groove, into which the forward point of the blade may readily be inserted. This assists in inserting the blade into the guard and in "starting" the insertion of the blade into the narrower portion of the groove.

Preferably the guard is shaped to curve upwardly to extend over the upwardly and rearwardly sloping edge at the front of the skate. This shaping gives a purchase between the skate and the guard at the upwardly and rearwardly extending portion of the guard. When the wearer of skate and guard is walking and places the rear of the guard down on the support surface, tending to rotate the forward end of the guard off the skate, the purchase between the skate and the guard prevents this. The contact between guard and skate at the upwardly and rearwardly extending forward portion of the guard thus increases the security with which the guard is retained on the skate.

In drawings which illustrate a preferred embodiment of the invention:

FIG. 1 shows perspective view of a skate of the newer type with a guard in accord with the invention, FIG. 2 shows a cross-section, whose direction is indicated by the lines 2—2 of FIG. 1, showing the relative shaping of the forward end of the blade and groove for insertion of the blade in the groove;

FIG. 3 shows a cross-section in the direction 3—3 of FIG. 1 indicating the relative shaping of the middle of the blade and of the middle of the guard, before the application of a blade thereto.

FIG. 4 is a cross-section in the direction indicated by the lines 3—3 but showing the stresses on the skate guard when worn by the wearer for walking;

FIG. 5 is a view of the rear of the skate guard along the lines 5—5 of FIG. 1; and FIG. 6 shows a guard embodying the same features as the guard in FIGS. 1–5 but designed for use with a figure skate.

FIG. 7 shows the transverse cross-section of an alternative form of the guard, in its contour before insertion of the blade into the guard. Thus FIG. 7 shows an alternative unstressed form of the guard to that shown in FIG. 3.

FIG. 8 shows the contour, in transverse cross-section of the guard of FIG. 7, after insertion of the blade into the guard but before the weight of the wearer presses such guard on a support surface.

In the drawings is shown the preferred form of the guard 10 embodying the principles earlier discussed, comprising a longitudinally extending body having a forward end 12 turned upwardly and rearwardly and a rear end 14 slightly upwardly turned. The cross section of the main extent of the guard is best shown in FIG. 3. As shown in this Figure, the guard defines an upwardly opening groove 16 wide enough at the bottom to receive the width of the skate blade without undue flexing but narrowing at the top 18 to a groove width less than the width of the blade. It will thus be obvious that the shape of guard and groove defines two lips 20 one on each side of the groove which lips 20 are spread on insertion of the skate blade and then resiliently clamp the guard to the blade. As shown the bottom of the guard defines an approximately indicated extent E which will be in contact with the support surface when a wearer is walking with his skates and guard thereon. Over this extent E the guard is shaped so that, in transverse cross-section, as shown in FIGS. 2, 3 and 4, the bottom surface is shaped to be concave downward, defining ridges 24 downwardly projecting on each side of the bottom surface. FIG. 4 shows in solid lines the shape of the guard with no weight thereon and in dotted lines shows the shape of the guard with the weight of the wearer thereon. As will be obvious from the arrows of FIG. 4, when the weight of the wearer is transmitted through the skate guard to a supporting surface, this takes place through the ridges 24, the resultant forces indicated by the vertical arrows tend to flatten the concavity between the ridges and hence to rotate the ridges upwardly relative to the median extent between the ridges, tending to rotate the lips 20 inwardly under forces as indicated by the sloping arrows to better clamp the skate. Thus the guard is more securely clamped to the skate when the wearer is walking on it.

Preferably the bottom surface of the guard, encompassing the concave downward surface, is wider than the upper portion of the guard represented by the two lips 20, all as shown in the cross-sectional views. The opposite side walls 26 of the guard are tapered upwardly and inwardly from bottom to top. This tapering thickness of material not only provides strength to the guard but acts (see FIG. 4) to directly transfer upward stress on the ridges 24 into inward pressure by the inner surfaces of the lips 20 on the blade.

For easy insertion of the blade into the groove a short forward extent 28 of the upper portion of the groove shown in FIG. 2 is wider than the narrowed upper portion (over the main extent and shown in FIG. 3) so that in the forward extent 28 the spacing between the inner surfaces of the lips is wide enough to readily receive the forward end of the skate blade. After insertion of the point of the blade in the widened portion 28 the insertion of the remainder of the blade into the remainder of the groove is rendered easier. The widened portion between the lips is preferably chamferred to lead into the narrower portion, as shown at 30.

It will be noted that the inner upper facing surfaces of the lips 20 over the narrowed extent are rounded to slope outward slightly to guide the blade into the narrowed path.

At the forward end 12, the guard is bent upwardly and rearwardly to extend about the front end of the skate blade. The groove 16 therein is contoured to conform approximately to the shape of the front end of the blade. The rearwardly facing, rearwardly and upwardly sloping surface 34 of the forward end of the guard is shaped to lie against the upwardly and rearwardly sloping portion 36 of plastic in a new skate or a portion 38 of the blade in an old or figure skate. Either the upward contour of the front of the groove as shown in FIGS. 1 or 6 or surface 34 supply means to prevent longitudinal movement therepast of the end of a skate blade inserted in said groove. As shown the rearwardly upwardly sloping side 34 makes a small angle A with the vertical direction V and this conforms to the angle of the relevant skate part as described above. This area 34 supplies the 'purchase' which resists rotation of the forward end of the guard off the skate.

It is within the scope of the invention to have the rearward end 14 of the guard define a contour to conform to the downwardly facing portion of the rear end of the skate blade edge. However it will be noted noted, given the clamping features of the inventive guard, adequate and secure attachment of the guard to the skate may be achieved where the skate is substantially shorter than the guard and the guard groove. The preferred form of the invention provides for the situation where the skate is longer than the guard by opening the groove to its full depth to the rear edge of the guard as best shown in FIG. 5. With this arrangement, the rear end of the skate blade may project rearwardly a short distance out of the rear end of the guard without discomfort to the wearer or insecurity in the attachment of the guard.

The drawings show alternative groove depths at the front of the guard. The shallower forward groove depth of FIG. 1 represents preferred form for the invention for use of the guard with hockey skates while the deeper forward groove depth of FIG. 6 represents the preferred form of the invention for use with figure skates. It will be also noted that the guard and groove of FIG. 1 is slightly curved from end to end in side view to conform to the usual contour of hockey skates while the major extent of the guard and groove of FIG. 6 are straight in side view to conform to the usual contour of Figure skates.

FIG. 7 shows, in transverse cross-section of a guard, in accord with the invention of alternate cross-sectional contour to that shown in FIGS. 1–6. The guard shown in FIG. 7 is in all respects similar to the guard of FIGS. 1–6 except that the lower surface 25 of the guard is substantially straight in a transverse direction, when, as is the case in FIG. 7, there is no blade contained therein. When the blade is inserted in the groove, as shown in FIG. 8, there is outward pressure of the blade on the guard material forming the narrowed portion of the groove. This outward pressure causes this material to move outwardly and bends the guard as a whole to make the bottom surface 25 concave downwardly as shown in FIG. 8 with a ridge on each side of the bottom similar to the ridges 24 of FIGS. 1–6. When the guard, with the skate therein, as shown in FIG. 8 is applied to a support surface, then bears the weight of the wearer, the operation is the same as demonstrated and described in connection with FIG. 4.

The bottom of the guard or of the downwardly projecting ridges may be provided with tread undulations if desired.

The guard may be made of any material of sufficient strength which has the necessary flexibility resiliency and other functional properties for the operation of the guard as described herein. We prefer to use molded plastic. Rubber of sufficient strength and high modulus could be used. At this time we intend to use low density polyethylene for production of a molded plastic skate guard in accord with the invention.

It is desired to reiterate that the inventive skate guard described herein is useful not only with the newer skate designs but with the older ones also.

I claim:

1. A skate guard shaped to extend longitudinally along the bottom edge of a skate blade, said guard being shaped to define an upwardly opening groove running longitudinally therealong said groove being of a length to receive a skate blade, said groove over a longitudinal extent before blade insertion narrowing toward its upper opening to a transverse dimension less than the thickness of a skate blade, said guard being made of flexible resilient material whereby when a skate blade is inserted in said groove, the material of said guard is resiliently biased outwardly by said blade and bears inwardly thereon to grip it, whereby said guard attaches to said blade without longitudinal stretching and wherein the inward pressure by the material on each side of said groove is the sole means of securing said guard to said skate, means adjacent one end of said groove to prevent longitudinal movement therepast of the corresponding end of a skate blade inserted in said groove, wherein said guard is shaped to define a bearing extent over a longitudinal extent of its lower surface, said guard being shaped so that said bearing extent is concave downward in transverse cross section, defining spaced bearing ridges running longitudinally along said guard on each side of a concavity, whereby under downward pressure of said guard on a supporting surface said spaced ridges cause the guard material on each side of said groove to press more firmly on said blade.

2. Skate guard as claimed in claim 1 wherein said guard is shaped to define a bearing extent over a longitudinal extent of its lower surface, said bearing extent is wider in a transverse direction that the upper portion of said guard, and the transverse thickness of said guard tapers upwardly from said bearing area to said upper portion.

3. Skate guard as claimed in claim 2 wherein said groove has a widened upper portion forwardly of the extent having said transverse dimension, said widened upper portion being dimensioned to readily receive the forward end of such skate blade.

4. Skate guard as claimed in claim 1 wherein said groove has a widened upper portion forwardly of the extent having said transverse direction, said widened upper portion being dimensioned to readily receive the forward end of such skate blade.

5. Skate guard as claimed in claim 4 wherein the forward end of said guard defines a rearwardly facing, rearwardly and upwardly sloping surface designed to contact a similarly sloping portion of the forward end of the skate.

6. Skate guard as claimed in claim 1 wherein the forward end of said guard defines a rearwardly facing, rearwardly and upwardly sloping surface designed to contact a similarly sloping portion of the forward end of the skate.

7. A skate guard shaped to extend longitudinally along the bottom edge of a skate blade, said guard being shaped before blade insertion to define an upwardly opening groove running longitudinally therealong and open to one end of said guard, said groove over a longitudinal extent narrowing toward its upper opening to a transverse dimension less than the thickness of a skate blade, said guard being made of flexible resilient material whereby when a skate blade is inserted in said groove, the material of said guard is resiliently biased outwardly by said blade and bears inwardly thereon to grip it, whereby said guard attaches to said blade without longitudinal stretching and wherein the inward pressure by the material on each side of said groove is the sole means of securing said guard to said skate, means adjacent the end of said groove opposite said one end to prevent longitudinal movement therepast of the corresponding end of a skate blade inserted in said groove, wherein said guard is shaped to define a bearing extent over a longitudinal extent of its lower surface, said guard being shaped so that said bearing extent is concave downward in transverse cross section, defining spaced bearing ridges running longitudinally along said guard on each side of a concavity, whereby under downward pressure of said guard on a supporting surface said spaced ridges cause the guard material on each side of said groove to press more firmly on said blade.

8. Skate guard as claimed in claim 7 wherein said guard is shaped to define a bearing extent over a longitudinal extent of its lower surface, said bearing extent is wider in a transverse direction than the upper portion of said guard, and the transverse thickness of said guard tapers upwardly from said bearing area to said upper portion.

9. Skate guard as claimed in claim 8 wherein said groove has a widened upper portion forwardly of the extent having said transverse dimension, said widened upper portion being dimensioned to readily receive the forward end of such skate blade.

10. Skate guard as claimed in claim 7 wherein said groove has a widened upper portion forwardly of the extent having said transverse dimension, said widened upper portion being dimensioned to readily receive the forward end of such skate blade.

11. Skate guard as claimed in claims 7 or 8 wherein the forward end of said guard defines a rearwardly facing, rearwardly and upwardly sloping surface designed to contact a similarly sloping portion of the forward end of the skate.

12. Skate guard as claimed in claims 10, 3 or 9 wherein the forward end of said guard defines a rearwardly facing, rearwardly and upwardly sloping surface designed to contact a similarly sloping portion of the forward end of the skate.

13. A skate guard shaped to extend longitudinally along the bottom edge of a skate blade, said guard being shaped to define an upwardly opening groove running longitudinally therealong said groove being of a length to receive a skate blade, said groove over a longitudinal extent before blade insertion narrowing toward its upper opening to a transverse dimension less than the thickness of a skate blade, said guard being made of flexible resilient material whereby when a skate blade is inserted in said groove, the material of said guard is resiliently biased outwardly by said blade and bears inwardly thereon to grip it, means adjacent one end of said groove to prevent longitudinal movement therepast of the corresponding end of a skate blade inserted in said groove, wherein said guard is shaped to define a bearing extent over a longitudinal extent of its lower surface, said member being shaped so that, with no skate in said guard, said bearing extent is substantially straight in transverse cross-section, whereby when a skate blade is inserted in said guard, the outward pressure of said blade on the material defining said groove, where said groove narrows, causes said bearing extent to assume a concave downward shape in transverse cross section, defining spaced bearing ridges running longitudinally along said guard on each side of a concavity.

14. Skate guard as claimed in claim 13 wherein said groove has a widened upper portion forwardly of the extent having said transverse dimension, said widened upper portion being dimensioned to readily receive the forward end of such skate blade.

15. Skate guard as claimed in claim 14 wherein said bearing extent is wider in a transverse direction than the upper portion of said guard, and the transverse thickness of said guard tapers upwardly from said bearing area to said upper portion.

16. Skate guard as claimed in claim 13 wherein said bearing extent is wider in a transverse direction than the upper portion of said guard, and the transverse thickness of said guard tapers upwardly from said bearing area to said upper portion.

17. A skate guard shaped to extend longitudinally along the bottom edge of a skate blade, said guard being shaped before blade insertion to define an upwardly opening groove running longitudinally therealong and open to one end of said guard, said groove over a longitudinal extent narrowing toward its upper opening to a transverse dimension less than the thickness of a skate blade, said guard being made of flexible resilient material whereby when a skate blade is inserted in said groove, the material of said guard is resiliently biased outwardly by said blade and bears inwardly thereon to grip it, means adjacent the end of said groove opposite said one end to prevent longitudinal movement therepast of the corresponding end of a skate blade inserted in said groove, wherein said guard is shaped to define a bearing extent over a longitudinal extent of its lower surface, said member being shaped so that, with no skate in said guard, said bearing extent is substantially straight in transverse cross-section, whereby when a skate blade is inserted in said guard, the outward pressure of said blade on the material defining said groove, where said groove narrows, causes said bearing extent to assume a concave downward shape in transverse cross section, defining spaced bearing ridges running longitudinally along said guard on each side of a concavity.

18. Skate guard as claimed in claim 17 wherein said groove has a widened upper portion forwardly of the extent having said transverse dimension, said widened upper portion being dimensioned to readily receive the forward end of such skate blade.

19. Skate guard as claimed in claim 18 wherein said bearing extent is wider in a transverse direction than the upper portion of said guard, and the transverse thickness of said guard tapers upwardly from said bearing area to said upper portion.

20. Skate guard as claimed in claim 17 wherein said bearing extent is wider in a transverse direction than the upper portion of said guard, and the transverse thickness of said guard tapers upwardly from said bearing area to said upper portion.

21. Skate guard as claimed in claims 13, 17 or 19 wherein the forward end of said guard defines a rearwardly facing rearwardly and upwardly sloping surface designed to contact a similarly sloping portion of the forward end of the skate.

22. Skate guard as claimed in claims 18, 16 or 20 wherein the forward end of said guard defines a rearwardly facing rearwardly and upwardly sloping surface designed to contact a similarly sloping portion of the forward end of the skate.

23. Skate guard as claimed in claims 15 or 19 wherein the forward end of said guard defines a rearwardly facing rearwardly and upwardly sloping surface designed to contact a similarly sloping portion of the forward end of the skate.

* * * * *